US006188984B1

(12) United States Patent
Manwaring et al.

(10) Patent No.: US 6,188,984 B1
(45) Date of Patent: Feb. 13, 2001

(54) METHOD AND SYSTEM FOR SYLLABLE PARSING

(75) Inventors: Michael E. Manwaring, Pleasant Grove; Steven F. McDaniel, Provo; Kara Felix, Salt Lake City; Melissa Wallentine, Springville; Starla Blackburn, American Fork, all of UT (US)

(73) Assignee: Fonix Corporation, Salt Lake City, UT (US)

( * ) Notice: Under 35 U.S.C. 154(b), the term of this patent shall be extended for 0 days.

(21) Appl. No.: 09/193,722

(22) Filed: Nov. 17, 1998

(51) Int. Cl.[7] ..... G10L 13/06; G10L 13/08
(52) U.S. Cl. ..... 704/260; 704/251; 704/254
(58) Field of Search ..... 704/258, 260, 704/231, 200, 254, 251

(56) References Cited

U.S. PATENT DOCUMENTS

| | | | | |
|---|---|---|---|---|
| 4,811,400 | * | 3/1989 | Fisher | 704/260 |
| 4,831,654 | * | 5/1989 | Dick | 704/260 |
| 5,528,728 | * | 6/1996 | Matsuura et al. | 704/254 |
| 5,651,095 | * | 7/1997 | Ogden | 704/260 |
| 5,732,395 | * | 3/1998 | Silverman | 704/260 |
| 5,758,023 | * | 5/1998 | Bordeaux | 704/235 |
| 5,852,802 | * | 12/1998 | Breen et al. | 704/260 |

OTHER PUBLICATIONS

Michel Divay and Anthony J. Vitale, "Algorithms for Grapheme–Phoneme Translation for English and French: Applications for Database Searches and Speech Synthesis," Computational Linguistics, US, Cambridge, MA, vol. 23, No. 4, pp. 495–523, XP002110490, Dec. 1997 (1997–12).

M. Edgington et al., "Overview of Current Text–To–Speech Techniques: Parti–Test and Linguistic Analysis," BT Technology Journal, vol. 14, No. 1, pp. 68–83, Jan. (1996).

IBM Technical Disclosure Bulletin, "Rule–Based Speech Synthesis Method Using Context–Dependent Syllabic Units," vol. 38, No. 12, pp. 521–522, Dec. 1995.

* cited by examiner

*Primary Examiner*—Richemond Dorvil
*Assistant Examiner*—Daniel A Nolan
(74) *Attorney, Agent, or Firm*—Finnegan, Hendersom, Farabow, Garrett & Dunner, L.L.P.

(57) ABSTRACT

A method and system consistent with the present invention parses text into syllables. The text is converted into a sequence of "phonemes," basic units of pronounceable and audible speech, divided by syllables. The text may be converted into phonemes using a phonetic dictionary, and the phonemes transformed into another phoneme sequence using a set of transformation rules that are ranked for evaluation to determine the syllable barriers.

8 Claims, 5 Drawing Sheets

METHOD AND SYSTEM FOR SYLLABLE PARSING

BACKGROUND

1. Field of the Invention

The present invention generally relates to syllable parsing, and more particularly, it relates to a method and system for converting text into phonetic syllables.

2. Related Art

Many devices currently use computer-generated speech for users' convenience. Automatically generating speech devices range from large computers to small, electronic devices. For example, an automatic telephone answering system, such as voicemail, can interact with a caller through synthesized voice prompts. A computer banking system can report account information via speech. On a smaller scale, a talking clock can announce the time. The use of talking devices is increasingly expanding and will continue to expand as innovation and technology progresses.

Often, for ease-of-use, synthesized speech is generated from text inputted to a speech generating device. These devices receive text, translate it, and output sound in the form of speech through a speaker. However, when translating and reciting the text, these devices do not always speak as clearly and naturally as a human does, therefore synthesized speech is recognizably artificial.

Making a computer or electronic device produce natural sounding speech requires a keen understanding of the nuances of the language and can be difficult for programmers. Computer-generated speech often seems unnatural for a variety of reasons. Some systems pre-record verbal responses in audio files, but when the words are played back in a different order than they were recorded, the response can sound extremely unnatural. One key aspect in the production of natural sounding, computer-generated speech is the ability to recognize boundaries between syllables. The recognition of syllable boundaries allows a speech-generating computer to speak in a more natural manner. The production of more natural sounding synthesized speech would further integrate computers into society and make them seem more user-friendly.

Automatic speech recognition ("ASR") devices perform the reverse function of text-to-speech devices. Computers and other electronic devices are increasingly using ASR as a form of input from a user. ASR applications range from word processing to controlling basic functions of electronic devices, such as automatically dialing a telephone number associated with a spoken name. ASR functions are implemented using computationally intensive programs and algorithms. A thorough understanding of boundaries between syllables in a language also makes the precise recognition of speech easier. Greater understanding of the segmentation of a speech signal improves the recognition of the speech signal.

Accordingly, to improve computer speech production and recognition, it is desirable to provide a system that recognizes syllable boundaries.

SUMMARY

Systems and methods consistent with the present invention satisfy this and other desires by providing a method for parsing text into syllables. In accordance with the present invention, a method and system is provided that parses text into "phonemes," basic units of pronounceable and audible speech, divided at syllable boundaries. The phonetic syllables can then be used by other computer speech applications, such as text-to-speech devices to produce smooth, natural sounding speech.

In accordance with methods consistent with the present invention, a method for parsing syllables is provided in a data processing system. This method receives a text string, converts the text string into a phoneme sequence, and generates a transformed phoneme sequence from the phoneme sequence according to transformation rules. The method further ranks the phonemes of the transformed phoneme sequence, generates a syllable rank meter for the transformed phoneme sequence, and transforms the transformed phoneme sequence into syllables using the syllable rank meter.

The advantages accruing to the present invention are numerous. It allows text to be automatically converted into phonetic syllables. These phonetic syllables can then be used by a text-to-speech computer application to produce natural sounding, computer-generated speech. Making automatically-generated speech sound more natural can increase a user's comprehension of the generating device and make the device more pleasing to the ear. Additionally, voice recognition systems can use the information of the syllable boundaries to improve speech recognition.

The above features, other features and advantages of the present invention will be readily appreciated by one of ordinary skill in the art from the following detailed description of the preferred implementations when taken in connection with the accompanying drawings.

BRIEF DESCRIPTION OF THE DRAWINGS

The accompanying drawings, which are incorporated in and constitute a part of this specification, illustrate an implementation of the invention and, together with the description, serve to explain the advantages and principles of the invention. In the drawings.

DETAILED DESCRIPTION

Overview

Methods and systems consistent with the present invention receive a text string and convert the text string into phonetic syllables. These phonetic syllables may then be used by other speech production and recognition applications for efficient and effective processing.

Generally, systems consistent with the present invention accept text written, for example, in English. The text is received by a phonetic converter that contains a phonetic dictionary that maps words to phonemes. The phonetic converter outputs a sequence of phonemes and passes the sequence to the phonetic transformer. Upon receipt, the phonetic transformer generates a transformed phoneme stream from the incoming phoneme sequence using a set of transformation rules.

The phonemes in the transformed phoneme sequence are ranked according to a ranking table, and the rankings are then plotted on a syllable rank meter. Finally, a syllable parser uses this syllable rank meter to separate the transformed phoneme sequence into syllables.

System Description

Figure 1:
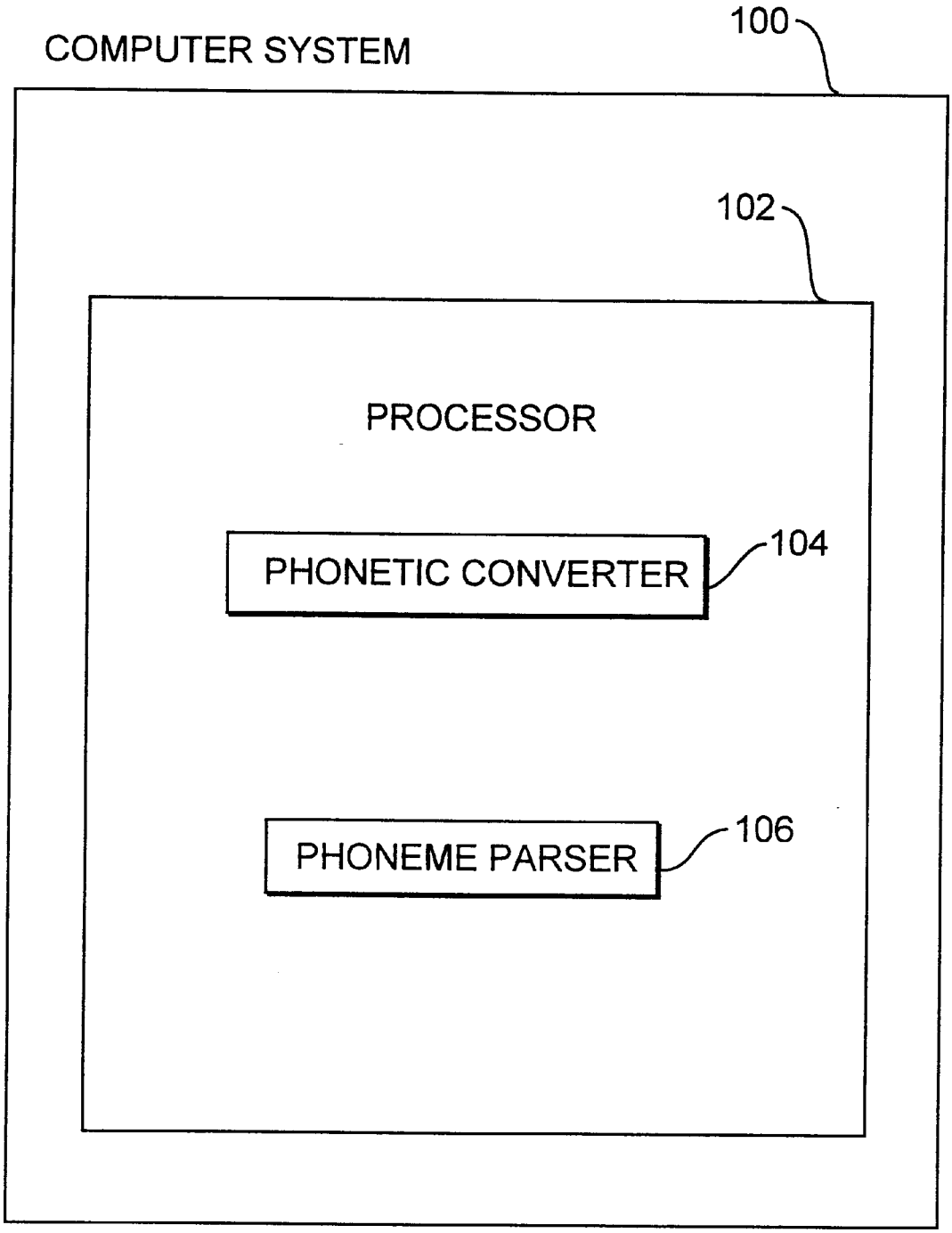
FIG. 1 is a block diagram of a computer system for parsing syllables from text in accordance with a method consistent with the present invention.

FIG. 1 illustrates a computer system 100 for parsing text into phonetic syllables consistent with the present invention. The computer system 100 includes a processor 102. In this implementation of the present invention, this processor 102 further includes a phonetic converter 104 and a phoneme parser 106.

The phonetic converter 104 is used for converting the text into a phoneme sequence and may be a hardware or software component. Similarly, the phoneme parser 106 parses the phoneme sequence produced by the phonetic converter 104 into a sequence of phonetic syllables. This component may also be hardware or software.

The computer system 100 may be a general purpose computer that runs the necessary software or contains the necessary hardware components for implementing methods consistent with the present invention. It should also be noted that the phonetic converter 104 and phoneme parser 106 may be separate devices located outside of the computer system 100 or may be software components on another computer system linked to computer system 100. It should also be noted that computer system 100 may also have additional components.

Figure 2:
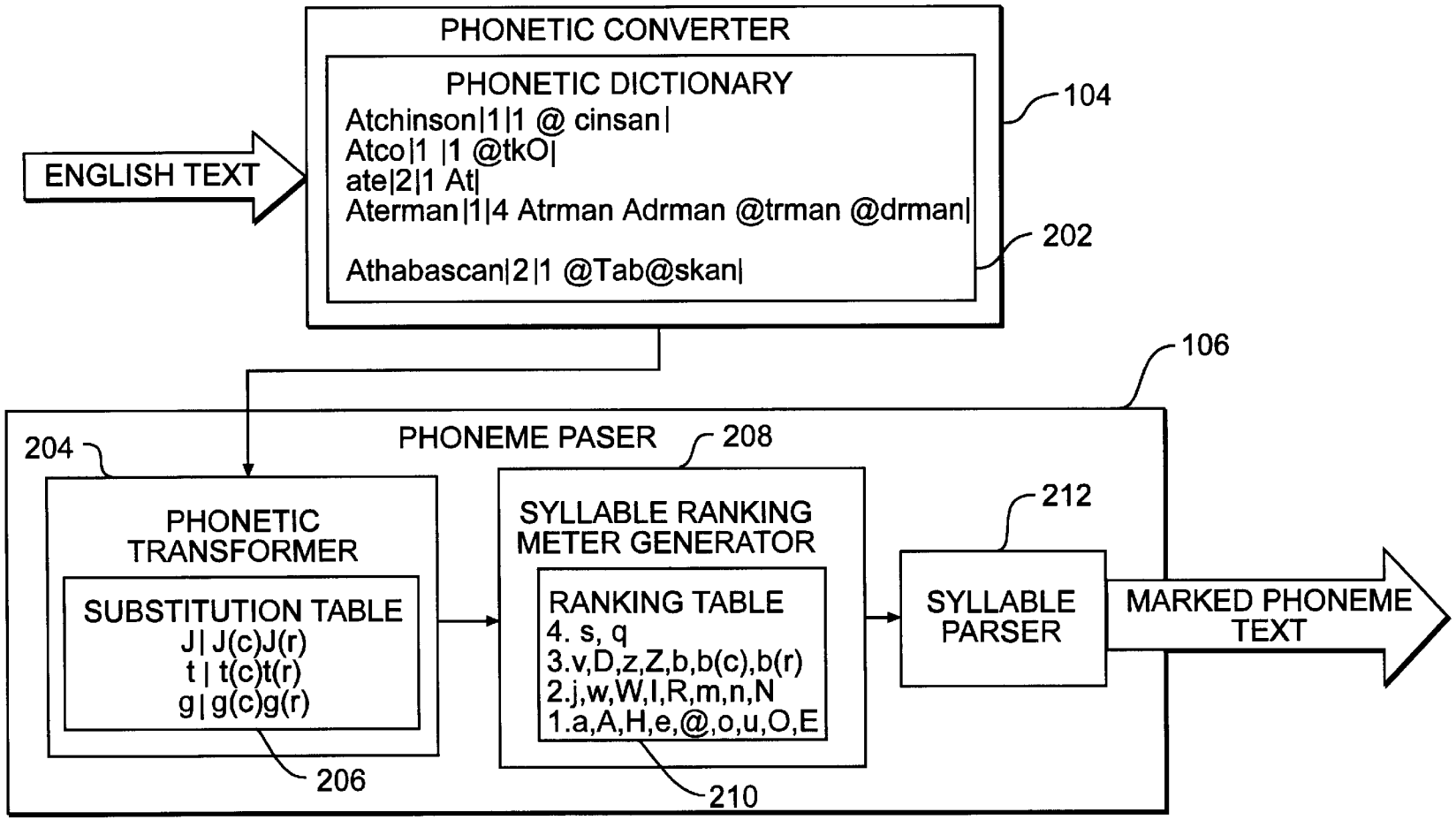
FIG. 2 is a block diagram of a phonetic converter and a phoneme parser in accordance with a method consistent with the present invention.

FIG. 2 illustrates the phonetic converter 104 and phoneme parser 106 in greater detail. As shown in FIG. 2, the phonetic converter 104 includes a phonetic dictionary 202 that has a mapping of words to their phonemes. This phonetic dictionary 202 can be, for instance, a text file containing words, phonemes and any other relevant referencing information, such as the number of different types of speech (e.g., noun or verb) and the number of phonetic spellings. An example of a few lines in an exemplary phonetic dictionary 202 is shown in the phonetic dictionary 202 block in FIG. 2. When given a text word, the phonetic converter 104 returns the corresponding phoneme by accessing the phonetic dictionary 202.

The phoneme parser 106, as shown in FIG. 2, contains a phonetic transformer 204, a syllable ranking meter generator 208 and a syllable parser 212. The phonetic transformer 204 uses a set of transformation rules to transform the phoneme sequence produced by the phonetic converter 104. In this implementation consistent with the present invention, the transformation rules are implemented in a substitution table 206 located in the phonetic transformer 204. This substitution table 206 contains a mapping of phonemes to a modified sequence of phonemes, and the mapping implements the transformation rules. These transformation rules allow a phoneme sequence to be successfully parsed into syllables. The transformation rules are discussed in greater detail below.

The syllable ranking meter generator 208 contains a ranking table 210 that assigns a number to each phoneme in the transformed phoneme sequence produced by the phonetic transformer 204. In this implementation, syllable ranking meter generator assigns a rank, a number one through four, to each phoneme. Finally, the syllable parser 212 receives the rankings and uses them to parse the transformed phonetic sequence into a sequence of syllables.

Syllable Parsing Method

Figure 3:
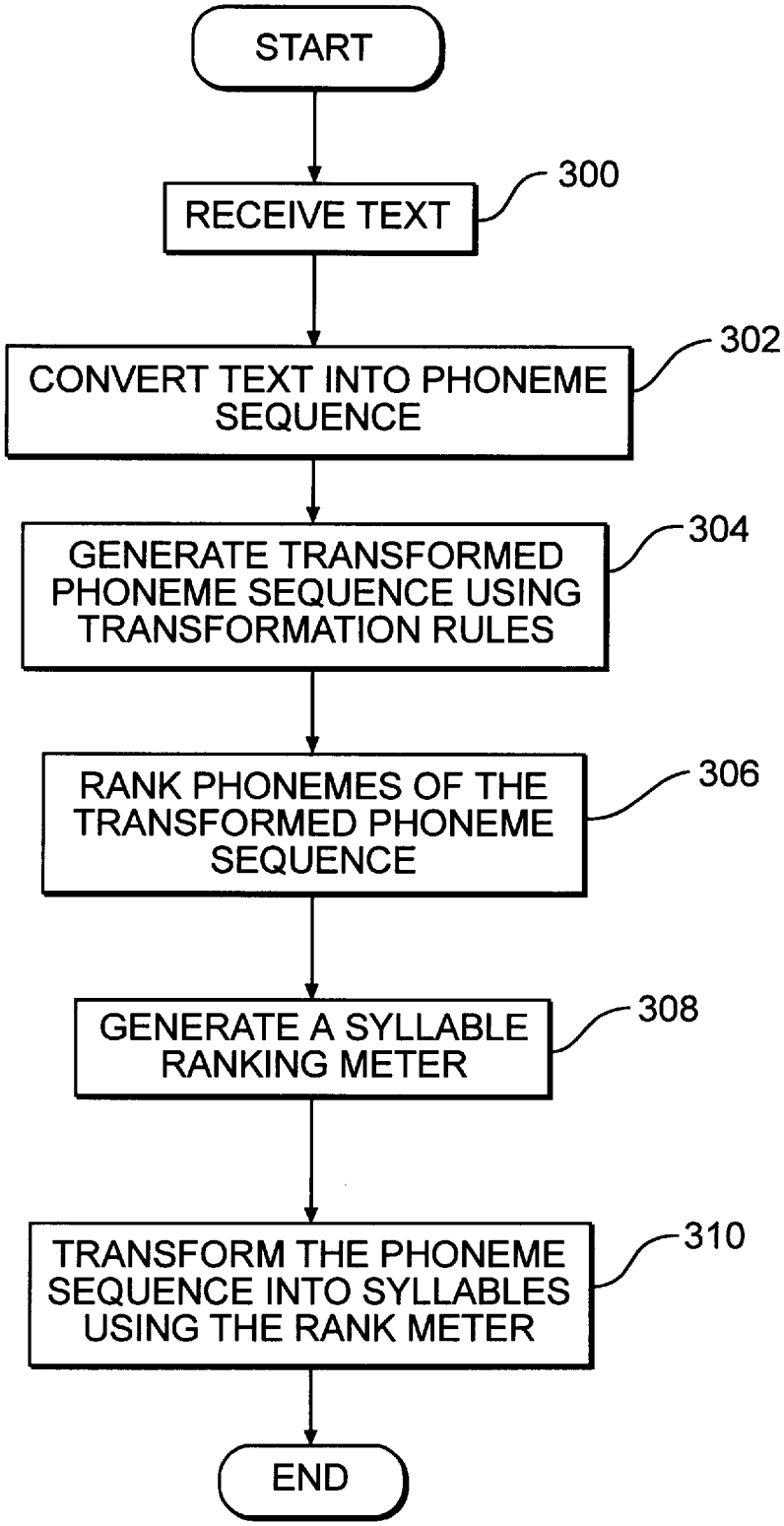
FIG. 3 is a flowchart illustrating steps performed in a method for syllable parsing consistent with the present invention.

FIG. 3 is a flowchart illustrating the steps used in a method for parsing syllables consistent with the present invention. These steps will also be discussed in conjunction with the components in FIG. 2. First, in one implementation of the present invention, the phonetic converter 104 receives English text (step 300). This text may be, for example, a text file in standard ASCII text format or may be input by a user from a keyboard. The phonetic converter 104 uses the phonetic dictionary 202 to convert the incoming text into a sequence of phonemes (step 302). In doing so, each word in the text is converted to a phoneme sequence, and the phonemes are placed in a sequence together.

The phonetic transformer 204 uses the substitution table 206 to generate a transformed phoneme sequence from the phoneme sequence received from the phonetic converter 104 (step 304). The substitution table 206 implements a set of transformation rules. These transformation rules allow the system to implement realistic functionality of the language when parsing syllables. For example, one of the rules transforms phonemes representing consonant pairs that cannot be pronounced together. For instance, when pronouncing the words "fast food," the "stf" cannot be pronounced together. As a result, a person generally says "fast," then has a short quiet and then says "food." This results in a quiet (denoted by a "q") between the "st" and the "f." Therefore, the transformation rule transforms "st" to "stqf."

In one implementation consistent with the present invention, the list of transformation rules are as follows:

1. Stop/Closures following quiet are invalid.
2. Double stops drop first release and second closure.
3. Insert quiet before syllabic nasals and liquids.
4. Insert glide or glottal stop between two vowels.
5. Insert quiet between illegal consonant pairs.
6. Insert a glide R between vowel r and vowels.
7. Stops consist of closure and release.
8. Voiced continuants geminate at peaks.

This list of transformation rules contains speech-related terminology which is known to those skilled in the art. For further description of these terms, refer to "The Acoustic Analysis of Speech," Ray D. Kent and Charles Read, Singular Publishing Group, Inc., 1992. In one implementation of the present invention, the specific application of each rule is set forth in the substitution table 206.

The substitution table 206 implements these rules by receiving a phoneme or phoneme sequence and returning a transformed phoneme or phoneme sequence. An exemplary substitution table 206 is listed in Appendix A at the end of this specification. Each line of the substitution table 206 contains a phoneme or sequence of phonemes, a "|" and another phoneme or sequence of phonemes. When the phonetic transformer 204 receives a phoneme or sequence of phonemes to the left of the "|", it returns the phoneme or sequence of phonemes on the right.

In one implementation of the present invention, the transformation rules are applied to the phoneme sequence in order. First, rule 1 is applied to each phoneme in the sequence, thus resulting in a transformed phoneme sequence. Then, rule 2 is applied to that phoneme sequence, and so on, until all of the rules have been applied to the phoneme sequence. This results in the final transformed phoneme sequence which is passed to the syllable ranking meter generator 208. In one implementation, the gemination rule (8) is a special rule. In this implementation, the substitutions governed by this rule are applied only at peaks of the syllable rank meter discussed below. Although, in other implementations, this rule is applied without special attention to peaks, it may prove to be especially effective when applied at peaks of the syllable rank meter described below.

Next, the syllable ranking meter generator 208 uses the ranking table 210 to generate a number from one to four for each phoneme in the transformed phoneme sequence received from the phonetic transformer 204 (step 306). As a result, there is one number generated for each phoneme in the transformed phoneme sequence. The ranking table 210 ranks the phonemes using the following general format:

| Value | Type of Phoneme |
|---|---|
| 4. | 'S,' quiet |
| 3. | Other Stridents (Plosives, Fricatives, Affricates, Voiced Fricatives, etc.) |
| 2. | Nasals, Liquids, Glides |
| 1. | Vowels |

These speech-related terms are known to those skilled in the art, and greater detail on these speech-related terms is also given in "The Acoustic Analysis of Speech," which was previously cited. In one implementation consistent with the present invention, the ranking table 210 is as follows:

RANKING TABLE

| Value | Phoneme |
|---|---|
| 4. | s, q |
| 3. | v, D, z, Z, b b(c), b(r), d, d(c), d(r), g, g(c), g(r), f, T, S, h, p, p(c), p(r), t, t(c), t(r), k, k(c), k(r), J, J(c), J(r), c, c(c), c(r) |
| 2. | j, w, W, l, R, m, n, N |
| 1. | OH, e, @, o, u, O, E, I, r, A, a, U, I, X, Y |

It should be noted that (c) denotes a closure phoneme, and (r) denotes a release phoneme, and the phonemes in the ranking table are further explained and defined in Appendix B at the end of the specification. The syllable ranking meter generator 208 performs a ranking that can be illustrated graphically, referred to as a "syllable ranking meter," of the phoneme rank numbers (step 308).

Figure 4:
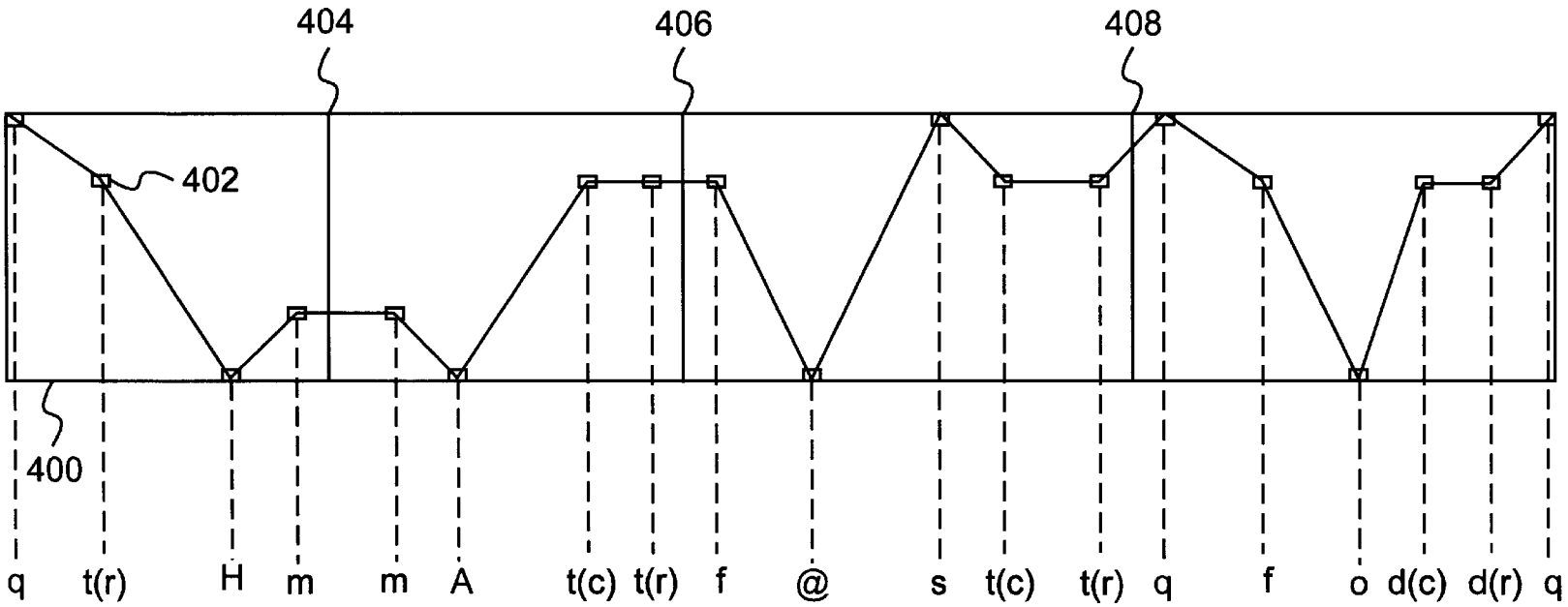
FIG. 4 is a diagram of a syllable rank meter in accordance with a method consistent with the present invention.

FIG. 4 illustrates an example of such a syllable ranking meter 400. As shown in FIG. 3, each of the positions 402 on the syllable ranking meter 400 has a height of 1, 2, 3, or 4, and the meter has a total length of the number of phonemes in the transformed phoneme sequence. A set of sample phonemes corresponding to the various rankings is also shown.

Finally, the syllable parser 212 uses the syllable ranking as illustrated by syllable ranking meter 400 to separate the transformed phonetic sequence into a sequence of phonetic syllables. First, the syllable parser 212 searches from left to right for a peak or plateau (i.e., two points on the syllable ranking meter 400 having the same rank). At each point on the graph where there is a plateau or peak, the syllable parser 212 searches, from left to right, for the next downward slope on the graph. When the syllable parser 212 finds a downward slope after a plateau or peak (not necessarily immediately after), it marks the syllable division right before the downward slope (i.e., between the two phonemes before the downward slope). The divisions 404, 406, and 408 on FIG. 4 mark the syllable boundaries between the phonemes. The syllable parser 212 places spaces between the phonemes at each of these divisions 404, 406 and 408, and the resulting phonetic sequence is therefore parsed into phonetic syllables.

In one implementation consistent with the present invention, if there is a valley between plateaus or peaks, it is not separated as a syllable unless there is a level 1 or 2 phoneme included between them.

EXAMPLE

Figure 5:
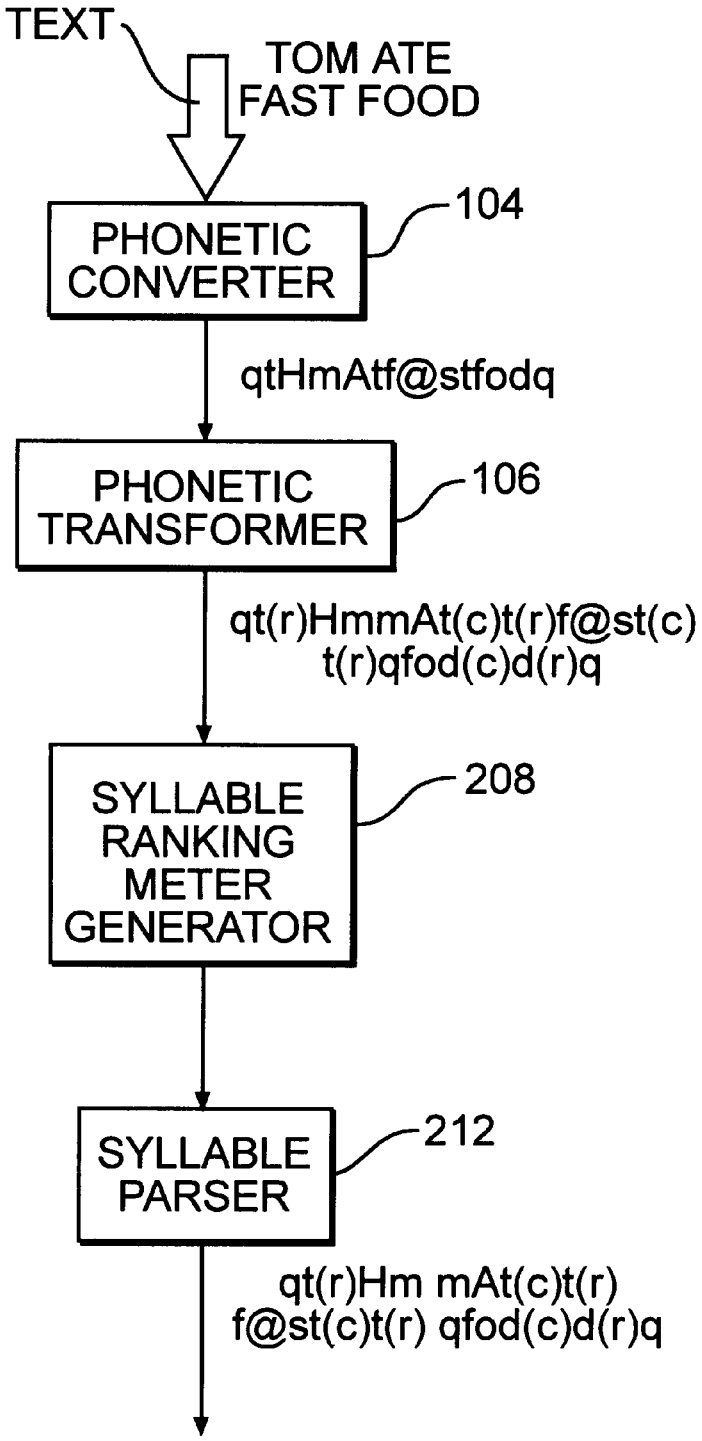
FIG. 5 is a block diagram illustrating an example of text input and the resulting output of various components in accordance with methods consistent with the present invention.

FIG. 5 shows a block diagram illustrating an exemplary system consistent with the present invention using an example of a specific text input. In this example, the text input is the sentence "Tom ate fast food." First, the phonetic converter 104 receives this text. The phonetic converter 104 converts this text into its corresponding sequence of phonemes using a phonetic dictionary 202. The resulting stream of phonemes is "qtHmAtf@stfodq." Then the sequence of phonemes is transferred to the phoneme parser 106 which uses the substitution table 206 to create a transformed phoneme sequence. In this example, this transformed phoneme sequence is "qt(r)HmmAt(c)t(r)f@st(c)t(r)qfod(c)d(r)q."

The transformed phoneme sequence is passed to the syllable ranking meter generator 208. The syllable ranking meter generator 208 generates a syllable ranking meter from the set of phonemes. In this example, there are 19 phonemes that are ranked using the ranking table 210. Each phoneme is given a rank of one, two, three or four. These ranks are used to generate the ranking meter.

Referring to FIG. 4, a syllable ranking meter 400 generated from the text input of this example is shown. FIG. 4 further shows the 19 phonemes corresponding to the ranks on the syllable ranking meter.

The syllable parser 212 uses the syllable ranking meter 400 to divide the transformed phonetic sequence into syllables. Searching from right to left, the syllable parser 212 searches for a plateau or peak. In this example, this plateau is found between the fourth and fifth phonemes. It then searches for the downward slope after the plateau. This next downward slope is found between the fifth and sixth phonemes. The syllable parser 212 then places the division right before the downward slope that follows the plateau. This division is placed between the fourth and fifth phonemes.

Next, the syllable parser 212 searches for the next plateau or peak, which is found between the seventh and ninth phonemes as shown in FIG. 4. After finding the plateau, it searches for the next downward slope which is between the ninth and tenth phonemes. As before, the syllable division 404 is placed right before the downward slope following the plateau between the eighth and ninth phonemes. As the syllable parser 212 continues, it should be noted that no division is placed before the "s" (the 11th phoneme) because the following valley does not contain a level 1 or 2 phoneme.

The syllable parser 212 then continues to the next plateau or peak. A peak is found at the fourteenth phoneme. It then searches for the next downward slope which is between the fourteenth and fifteenth phonemes. As a result, it places the syllable division 408 right before the downward slope, which is between the thirteenth and fourteenth phonemes as shown on the diagram. Once the positions of these syllable divisions 404, 406, and 408 are determined, spaces are placed between the phonemes of the transformed phoneme sequence. This results in the final output by the syllable parser 212, a sequence of phonemes divided into syllables. With a space between each syllable, this output, as shown on the diagram, is "qt(r)Hm mAt(c)t(r)f@st(c)t(r)qfod(c)d(r)q."

Methods and systems consistent with the present invention thus convert text into phonetic syllables. These phonetic syllables may then be used by other speech-related computer applications. These methods and systems enable speech-related computer applications to more efficiently produce natural sounding speech. Additionally, they also assist voice recognition applications to more efficiently and effectively recognize speech.

The foregoing description of an implementation of the invention has been presented for purposes of illustration and description. It is not exhaustive and does not limit the invention to the precise form disclosed. Modifications and variations are possible in light of the above teaching or may be acquired from practicing of the invention. The scope of the invention is defined by the claims and their equivalents.

APPENDIX A

| Substitution Table |
|---|
| //Rule 1: Stop/Closures following quiet are invalid. |
| qp(c) \| q |
| qb(c) \| q |
| qd(c) \| q |
| qc(c) \| q |
| qJ(c) \| q |
| qt(c) \| q |
| qg(c) \| q |
| qk(c) \| q |
| //Rule 2: Double stops drop first release and second closure. |
| p(r)p(c) \| |
| b(r)p(c) \| |
| d(r)p(c) \| |
| c(r)p(c) \| |
| J(r)p(c) \| |
| t(r)p(c) \| |
| g(r)p(c) \| |
| k(r)P(c) \| |
| p(r)b(c) \| |
| b(r)b(c) \| |
| d(r)b(c) \| |
| c(r)b(c) \| |
| J(r)b(c) \| |
| t(r)b(c) \| |
| g(r)b(c) \| |
| k(r)b(c) \| |
| p(r)d(c) \| |
| b(r)d(c) \| |
| d(r)d(c) \| |
| c(r)d(c) \| |
| J(r)d(c) \| |
| t(r)d(c) \| |
| g(r)d(c) \| |
| k(r)d(c) \| |
| p(r)c(c) \| |
| b(r)c(c) \| |
| d(r)c(c) \| |
| c(r)c(c) \| |
| J(r)c(c) \| |
| t(r)c(c) \| |
| g(r)c(c) \| |
| k(r)c(c) \| |
| p(r)J(c) \| |
| b(r)J(c) \| |

APPENDIX A-continued

| Substitution Table |
|---|
| d(r)J(c) \| |
| c(r)J(c) \| |
| J(r)J(c) \| |
| t(r)J(c) \| |
| g(r)J(c)\| |
| k(r)J(c) \| |
| p(r)t(c) \| |
| b(r)t(c) \| |
| d(r)t(c) \| |
| c(r)t(c) \| |
| J(r)t(c) \| |
| t(r)t(c) \| |
| g(r)t(c) \| |
| k(r)t(c) \| |
| p(r)g(c) \| |
| b(r)g(c) \| |
| d(r)g(c) \| |
| c(r)g(c) \| |
| J(r)g(c) \| |
| t(r)g(c) \| |
| g(r)g(c) \| |
| k(r)g(c) \| |
| p(r)k(c) \| |
| b(r)k(c) \| |
| d(r)k(c) \| |
| c(r)k(c) \| |
| J(r)k(c) \| |
| t(r)k(c) \| |
| g(r)k(c) \| |
| k(r)k(c) \| |
| //Rule 3: Insert quiet before syllabic nasals and liquids. |
| vm \| vqm |
| vn \| vqn |
| Dm \| Dqm |
| Dn \| Dqn |
| zm \| zqm |
| zn \| zqn |
| Zm \| Zqm |
| Zn \| Zqn |
| jm \| jqm |
| jn \| jqn |
| wm \| wqm |
| wn \|\| wqn |
| lm \| lqm |
| ln \| lqn |
| Rm \| Rqm |
| Rn \| Rqn |
| rm \| rqm |
| rn \| rqn |
| mn \| mqn |
| nm \| nqm |
| Nm \| Nqm |
| Nn \| Nqn |
| bm \| bqm |
| bn \| bqn |
| dm \| dqm |
| dn \| dqn |
| gm \| gqm |
| gn \| gqn |
| fm \| fqm |
| fn \| fqn |
| Tm \| Tqm |
| Tn \| Tqn |
| pm \| pqm |
| pn \| pqn |
| tm \| tqm |
| tn \| tqn |
| km \| kqm |
| kn \| kqn |
| Jm \| Jqm |
| Jn \| Jqn |
| cm \| cqm |
| cn \| cqn |
| bw \| bqw |
| dl \| dql |
| fw \| fqw |
| mR \| mqR |

APPENDIX A-continued

Substitution Table mj | mqj
mn | mqn
pw | pqw
sS | sqS
sD | sqD
sz | sqz
sj | sqj
sf | Sqf
Sl | Sql
Ss | Sqs
Sr | Sqr
St | Sqt
ST | SqT
SD | SqD
Sv | Sqv
Sz | Sqz
Sw | Sqw
sj | sqj
tj | tqj
Tl | Tql
Tw | Tqw
Tj | Tqj
Dl | Dql
Dw | Dqw
Dj | Dqj
Vl | vql
vw | vqw
//Rule 4: Insert glide or glottal stop between two vowels.
oE | owE
oi | owi
oA | owA
oe | owe
or | owr
oY | owY
Or | Owr
XY | XwY
XI | XwI
XE | XwE
Xi | Xwi
Ei | Eji
EA | EjA
Ee | Eje
E@ | Ej@
Ea | Eja
Eo | Ejo
EO | EjO
EH | EjH
Er | Ejr
EI | EjI
EX | EjX
EY | EjY
Er | Ejr
Ai | Aji
AY | AjY
AE | AjE
AA | AjA
Ae | Aje
A@ | Aj@
Aa | Aja
Ao | Ajo
AO | AjO
AH | AjH
Ar | Ajr
AI | AjI
AX | AjX
oE | owE
oi | owi
o@ | ow@
oa | owa
oO | owO
oH | owH
or | owr
oI | owI
oX | owX
oY | owY
oA | owA
oe | owe APPENDIX A-continued Substitution Table OI | OwI
OE | OwE
O| Owi
OA | OwA
Oe | Owe
O@ | Ow@
Oa | Owa
Oo | Owo
OO | OwO
OH | OwH
Or | Owr
OI | OwI
OX | OwX
OY | OwY
IY | IjY
Ie | Ije
Ii | Iji
IA | IjA
Ie | Ije
I@ | Ij@
Ia | Ija
Io | Ijo
IO | IjO
IH | IjH
Ir | Ijr
IX | IjX
XY | XwY
XA | XwA
Xe | Xwe
Xr | Xwr
XE | XwE
XO | XwO
XH | XwH
YA | YjA
Ye | Yje
Y@ | Yj@
Ya | Yja
Yo | Yjo
YO | YjO
YH | YjH
Yr | Yjr
YI | YjI
YX | YjX
YE | YjE
Yi | Yji
EE | EqE
AA | AqA
aa | aqa
HH | HqH
II | IqI
XX | XqX
YY | YqY
AE | AqE
Ae | Aqe
rr | rqr
aE | aqE
ao | aqo
aA | aqA
ae | aqe
ai | aqi
aX | aqX
aY | aqY
a@ | aq@
aa | aqa
aO | aqO
aH | aqH
ar | aqr
aI | aqI
aE | aqE
aY | aqY
HY |HqY
HA | HqA
HE | HqE
He | Hqe
HI | HqI
HH | HqH
H@ | Hq@

APPENDIX A-continued

Substitution Table

HE | HqE
HA | HqA
He | Hqe
Ha | Hqa
Ho | Hqo
HO | HqO
Hr | Hqr
HI | HqI
HX | HqX
HY | HqY
Hi | Hqi
IE | IjE

//Rule 5: Insert quiet between illegal consonant pairs.

ss | S
vm | vqm
vn | vqn
Dm | Dqm
Dn | Dqn
zm | zqm
zn | zqn
zp | zqp
zk | zqk
zf | zqf
zg | zqg
Zm | Zqm
Zn | Zqn
jm | jqm
jn | jqn
wm | wqm
wn | wqn
lm | lqm
ln | lqn
Rm | Rqm
Rn | Rqn
rm | rqm
rn | rqn
nf | nqf
mf | mqf
mn | mqn
nm | nqm
Nm | Nqm
Nn | Nqn
ND | NqD
fm | fqm
fn | fqn
Tm | Tqm
Tn | Tqn
sth | stqh
st(c)t(r)h | st (c) t (r)qh
stf | stqf
st(c)t(r)f | st(c)t(r)qf
stT | stqT
st(c)t(r)T | st(c)t(r)qT
stk | stqk
st(c)t(r)k | st(c)t(r)qk
stS | stqS
st(c)t(r)S | st(c)t(r)qS
stp | stqp
st(c)t(r)p |st(c)t(r)gp
stb | stqb
st(c)t(r)b | st(c)t(r)qb
stc | stqc
st(c)t(r)c | st(c)t(r)qc
stc | stqc
st(c)t(r)c | st(c)t(r)qc
st(c)t(r)J |st(c)t(r) qJ
stJ | stqJ
tsf | tsqf
t(c)t(r)sf |t(c)t(r)sqf
stJ | stqJ
st(c)J(r) | st(c)qJ(r)
Ng(c)g(r) | Ng(r)
b(r)m | b(r)qm
b(r)n| b(r)qn
d(r)m | d(r)qm
d(r)n | d(r)qn
g(r)m | g(r)qm

APPENDIX A-continued

Substitution Table g(r)n | g(r)qn
p(r)m | p(r)qm
p(r)n | p(r)qn
t(r)m | t(r)qm
t(r)n | t(r)qn
k(r)m | k(r)qm
k(r)n | k(r)qn
J(r)m | J(r)qm
J(r)n | J(r)qn
c(r)m | c(r)qm
c(r)n | c(r)qn //Rule 6: Insert a glide R between vowel r and vowels ra | rRa
rA | rRA
r@ | rR@
rE | rRE
ri | rRi
ro | rRo
rO | rRO
ru | rRu
rU | rRU
rY | rRY
rX | rRX
rH | rRH
rI | rRI //Rule 7: Stops consist of closure and release.

p | p(c)p(r)
b | b(c)b(r)
d | d(c)d(r)
c | c(c)c(r)
J | J(c)J(r)
t | t(c)t(r)
g | g(c)g(r)
k | k(c)k(r)

//Rule 8: Voiced continuants geminate at peaks.

v | vv
D | DD
z| zz
Z | ZZ
N | NN
R | RR
m | mm
n | nn
l | ll

APPENDIX B

Phonetic Symbol Key

| | |
|---|---|
| v | as v in van |
| D | as th in thy |
| z | as z in zip |
| Z | as s in measure |
| 0(Zero) | as au in hauled (Rare.) |
| H | as o in hot |
| e | as e in get |
| @ | as a in at |
| o | as oo in hoot |
| u | as oo in hood |
| o | as o in owed |
| E | as ea in eat |
| I | as i in it |
| j | as y in yet |
| w | as w in wed |
| l | as l in led |
| R | as r in red |
| A | as a in ate |
| a | as a in above |
| U | as o in above |
| I | as i in kite |
| X | as ow in cow |
| Y | as oi in coin |
| r | as er in herd |
| b | as b in bit |

APPENDIX B-continued

| Phonetic Symbol Key | |
|---|---|
| d | as d in dip |
| g | as g in get |
| m | as m in met |
| n | as n in net |
| N | an ng in lung |
| W | as wh in white |
| f | as f in fan |
| T | as th in thigh |
| s | as s in sip |
| s | as sh in ship |
| h | as h in hat |
| p | as p in pit |
| t | as t in tip |
| k | as k in kit |
| J | as g in gin |
| c | as ch in chin |

What is claimed is:

1. A method for parsing syllables in a data processor according to transformation rules, comprising the steps of:

receiving a text string;

converting the text string into a first phoneme sequence;

transforming the first phoneme sequence into a second sequence of phonemes according to the transformation rules;

forming a ranking of the phonemes of the second phoneme sequence according to predetermined criteria; and parsing the second phoneme sequence into syllables using the ranking.

2. The method of claim 1, wherein the transforming step includes the step of applying one or more of the following transformation rules:

stops and closures following quiet are invalid;

double stops drop first release and second closure;

insert quiet before syllabic nasals and liquids;

insert glide or glottal stop between two vowels;

insert quiet between illegal consonant pairs;

insert a glide R between vowel r and vowels;

stops consist of a closure and release; or voiced continuants geminate at peaks.

3. The method of claim 1, further including the steps of:

storing the transformation rules in a substitution table; and generating the second phoneme sequence using the substitution table.

4. A data processing system for parsing syllables, comprising:

a phonetic converter subsystem that receives a text string and converts the text string into a first phoneme sequence;

a phonetic transformer that receives and applies transformation rules to the first phoneme sequence to form a second sequence and phonemes;

an evaluator that assigns rankings to the phonemes in the second phoneme sequence according to predetermined criteria; and a syllable parser that receives the second phoneme sequence and uses the rankings to parse the phonemes in the second sequence into syllables.

5. The data processing system of claim 4, wherein the phonetic transformer includes a substitution table.

6. The data processing system of claim 4, wherein the phonetic converter subsystem includes a phonetic dictionary.

7. A data processing system for parsing syllables according to transformation rules, comprising:

means for converting text into a first phoneme sequence;

means for transforming the first phoneme sequence into a second sequence of phonemes according to the transformation rules;

means for forming a ranking of the phonemes in the second phoneme sequence according to predetermined criteria; and means for parsing the second phoneme sequence using the ranking.

8. A computer-readable medium containing instructions for performing by a processor a method for parsing syllables according to transformation rules, the method comprising the steps of:

receiving a text string;

converting the text string into a first phoneme sequence;

transforming the first phoneme sequence into a second sequence of phonemes according to the transformation rules;

forming a ranking of the phonemes of the second phoneme sequence according to predetermined criteria; and parsing the second phoneme sequence into syllables using the ranking.

* * * * *